US005950475A

United States Patent [19]

Penny

[11] Patent Number: 5,950,475

[45] Date of Patent: Sep. 14, 1999

[54] MECHANICAL COIN FEED FOR A SOUVENIR PENNY PRESS

[76] Inventor: Alexander D. Penny, P.O. Box 355, Toughkenanon, Pa. 19374

[21] Appl. No.: 08/964,742

[22] Filed: Nov. 5, 1997

[51] Int. Cl.[6] ..... B21H 09/00

[52] U.S. Cl. ..... 72/197; 72/424

[58] Field of Search ..... 72/184, 189, 191, 72/197, 198, 424; 101/4, 5, 6; 221/298

[56] References Cited

U.S. PATENT DOCUMENTS

| | | | |
|---|---|---|---|
| 1,956,999 | 5/1934 | Rupple | 221/298 |
| 2,819,816 | 1/1958 | Moeltzner et al. | 221/298 |
| 3,105,610 | 10/1963 | Aidlin et al. | 221/298 |
| 3,691,806 | 9/1972 | Hanazawa | 72/92 |

*Primary Examiner*—Lowell A. Larson
*Attorney, Agent, or Firm*—John F. A. Earley; John F. A. Earley, III; Harding, Earley, Follmer & Frailey

[57] ABSTRACT

A coin feed for a souvenir coin elongation machine having a housing, a coin slot formed in the top of the housing, a pair of embossing rolls having a predetermined number (N) of embossing plates spaced equally around the outer circumferential surface of at least one embossing roll, and a gravity fed coin chute connecting the coin slot to the embossing rolls. The coin feed has a coin feed housing and a pair of stops. Each of the stops is movable between a first limit position traversing the coin chute and a second limit position retracted out of said coin chute. Each stop is mechanically linked to said embossing rolls by a cam and a gear train. The mechanical coin feed is located intermediate the coin chute and advancees only one coin at a time to the embossing rolls each time the embossing rolls are rotated 1/N revolutions.

18 Claims, 4 Drawing Sheets

MECHANICAL COIN FEED FOR A SOUVENIR PENNY PRESS

FIELD OF THE INVENTION

The present invention relates to a mechanical coin feed for use in a souvenir coin elongation machine such as a penny press.

BACKGROUND OF THE INVENTION

Souvenir coin elongation machines, such as a penny press, are commonly found at tourist attractions such as museums and historical monuments. The coin elongation machine is used to make a souvenir, keepsake, and/or metal tag from a coin (such as a penny) or other round metal blank by mechanically elongating the coin/blank and embossing in the coin/blank a new design. The coin/blank is elongated and embossed by a set of high-pressure embossing rolls which are usually mechanically rotated by the tourist/customer.

In order to work properly, the coin/blank must be admitted to the embossing rolls at a precise radial location, i.e., the contact point between an embossing plate and the opposed embossing rolls. To ensure that the coin/blank is properly admitted to the embossing rolls, prior art coin elongation machines require the customer/tourist to initially configure the embossing roll to a precise location before inserting the coin/blank into the coin elongation machine. The customer configures the machine by rotating a handle until a dial indicator aligns with the desired design on the embossing roll. If the dial indicator is misaligned with the embossing roll, even by a few degrees, the embossing plate will not contact the coin at the precise location and the machine will produce a misrolled or defective souvenir.

Not suprisingly, cases have been reported of prior art coin elongation machines producing defective souvenirs due to the customer/tourist's error in configuring the machine. It is desirable to provide a device which feeds or admits the coin/blank to the embossing rolls at the precise radial location even if the machine is not precisely configured by the customer/tourist.

Some prior art coin elongation machines have electrically powered coin feed devices which use electronic sensors to correctly admit a coin/blank to the embossing rolls at the precise radial location. However, such electric coin feed devices are costly and are subject to error during power outages. Therefore, it is also desirable to provide a mechanical coin feed device which is not electrically powered or electronically controlled.

SUMMARY OF THE INVENTION

The present invention relates to a mechanical coin feed device for use in a souvenir coin elongation machine such as a penny press. The coin feed device feeds or admits the coin/blank to the embossing rolls precisely when an embossing plate is immediately proximate the contact point P between the two embossing rolls. The mechanical coin feed advances one coin at a time to the precise radial location of the embossing rolls even if the coin elongation machine is not precisely, initially configured by the customer/tourist. The coin feed of the present invention is mechanical and does not require electric power or have electric sensors.

The coin feed device of the present invention is used with a coin elongation machine having a housing, a coin slot formed in the top of the housing, a pair of embossing rolls, and a gravity fed coin chute connecting the coin slot to the embossing rolls. At least one of the embossing rolls has a predetermined number (N) of embossing plates spaced equally around the outer circumference of the roll.

The mechanical coin feed is located intermediate the coin chute and is constructed and arranged to selectively advance only one coin at a time to the embossing rolls. The coin feed is mechanically linked to the embossing rolls by a gear train. In a preferred embodiment, the coin feed advances a single coin to the embossing rolls each time the embossing rolls are rotated 1/N revolutions.

The coin feed has a pair of retractable stops traversing the coin chute. Each stop is normally biased to a closed position traversing the coin chute thereby preventing a coin from advancing down the coin chute past the stop. Each stop may also be moved to an open position retracted out of the chute thereby allowing a coin to advance down the coin chute past the stop.

In a preferred embodiment, the stops comprise pin actuator mechanisms having an elongate, cylindrical slide portion and an elongate, cylindrical pin portion. The stops divide the coin chute into a storage region intermediate the coin slot and the first (upper) stop, a unit region intermediate the first (upper) and second (lower) stops, and a supply region intermediate the second (lower) stop and the embossing rolls. The storage region is preferably large enough to contain multiple coins. The unit region is large enough to contain only one full coin.

Each of the stops is mechanically linked to a cam which is mechanically linked to the gear train. The cams and gear train are constructed and arranged so that the stops reciprocate between open and closed positions in a defined cycle to advance a single coin/blank to the embossing rolls.

Preferably, the pins oscillate in opposed directions between an open limit position and a closed limit position. Thus, when the first pin is in an open position, the second pin is in a closed position, and vice versa.

Initially, one or more coins are inserted into the coin chute and become stacked in the storage region above the upper stop which is in a closed position. The upper stop then moves to an open position allowing the lead (lowest in the stack) coin to advance downwardly into the unit region and contact the lower stop which simultaneously moved to a closed position when the upper pin moved to an open position. The upper stop then moves back to a closed position to prevent additional coins from entering the unit region while the lower stop simultaneously moves to an open position to allow the single coin in the unit region to advance through the chute to the embossing rolls.

In a preferred embodiment, the stops are offset from the widthwise center of the chute to prevent the stops from impinging on a coin when the stops move to a closed position. The pin actuators are spring loaded to prevent damage if one of the stops inadvertently impinges on a coin in the chute.

The present invention also relates to a method of making a souvenir coin. The method comprises the initial step of providing a souvenir coin elongation machine having a housing, a coin slot formed in the top of the housing, a pair of embossing rolls, and a gravity fed coin chute connecting the coin slot to the embossing rolls. At least one of the embossing rolls has a predetermined number (N) of embossing plates on the outer circumferential surface of one of the embossing rolls.

Multiple coins are stored in the coin chute. Only one coin is mechanically advanced to the embossing rolls for every 1/N revolutions of the embossing rolls. The coin is permanently deformed and embossed by the embossing rolls.

DESCRIPTION OF PREFERRED EMBODIMENTS

Figure 1:
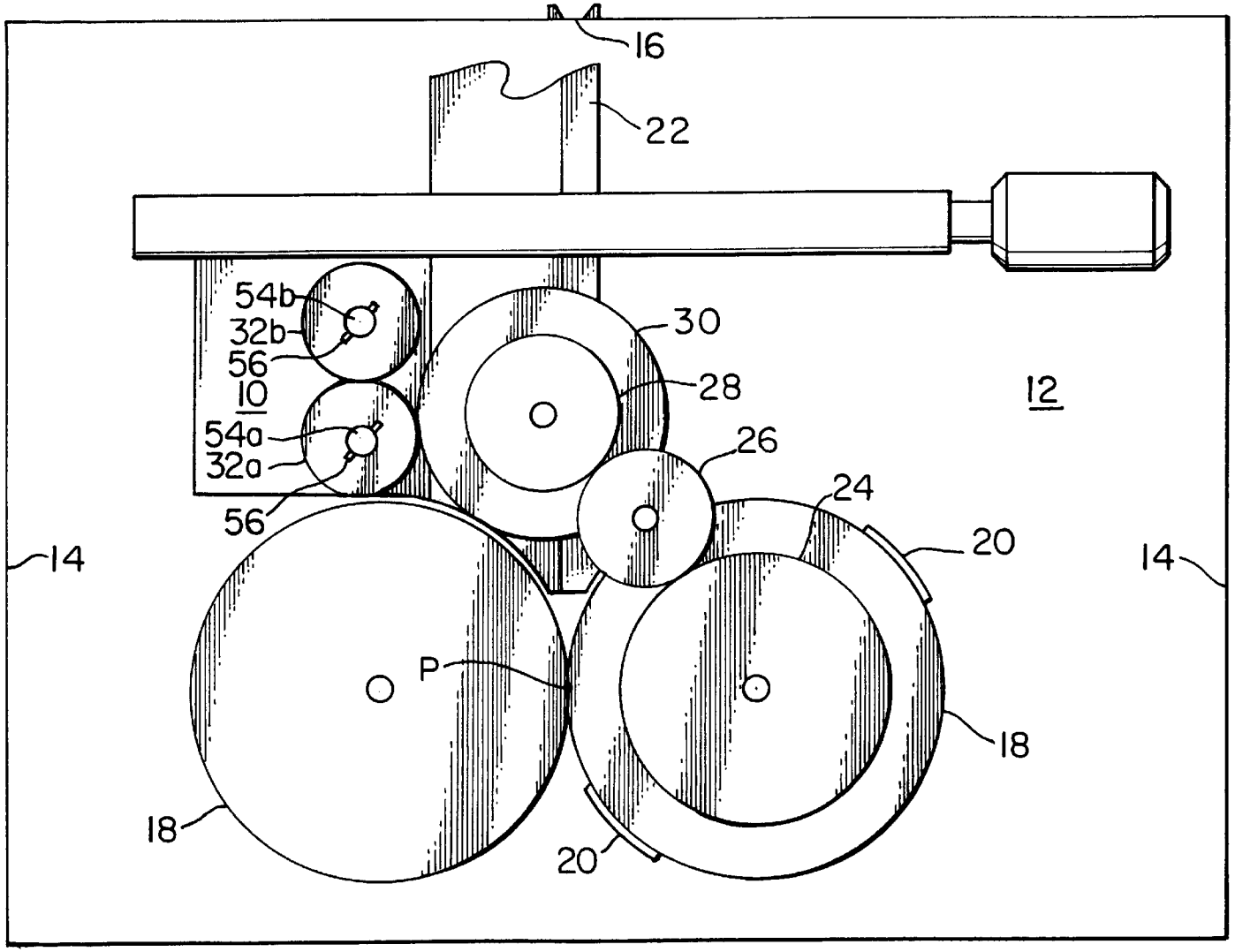
FIG. 1 is a schematic representation of a souvenir coin elongation machine in accordance with an embodiment of the present invention.

The mechanical coin feed device of the present invention is illustrated in FIGS. 1–7 and designated generally therein by reference numeral 10. A coin elongation machine of the present invention, designated generally by reference numeral 12, is schematically illustrated in FIG. 1 in combination with the mechanical feed device 10. The coin elongation machine 12 has a housing 14 and a coin slot 16 formed in the top of the housing 14 through which a coin (such as a penny) or a metal blank is inserted by the tourist/customer. The coin elongation machine 12 also has a pair of embossing rolls 18, at least one of which has a predetermined number (N) of embossing plates 20 which are equally spaced on the outer, circumferential surface of one embossing roll 18. A gravity fed coin chute 22 extends generally vertically downwardly from the coin slot 16 and ends at an area proximate the overlapping, contact point (P) of the embossing rolls 18.

The embossing roll 18 may have one or more embossing plates 20 so long as the plates are equally spaced around the outer, circumferential surface of the embossing roll 18. For example, the embossing roll illustrated in FIG. 1 has two embossing plates 20 radially spaced 180 degrees apart from one another.

The coin feed 10 of the present invention is fastened proximate the bottom of the coin chute 22. The coin feed 10 is mechanically linked to the embossing rolls by a gear train which comprises a series of intermeshed gears 24, 26, 28, 30 having a well known spacial arrangement. The coin feed itself has a pair of meshed gears 32*a*, 32*b*, each of which is mounted on a separate cam shaft 54*a*, 54*b*, described in greater detail below. One of the gears 32*a* meshes with one of the gears 30 of the gear train. As described in greater detail below, the gear train synchronizes movement of the coin feed 10 with rotation of the embossing rolls 18, 20.

Figure 2:
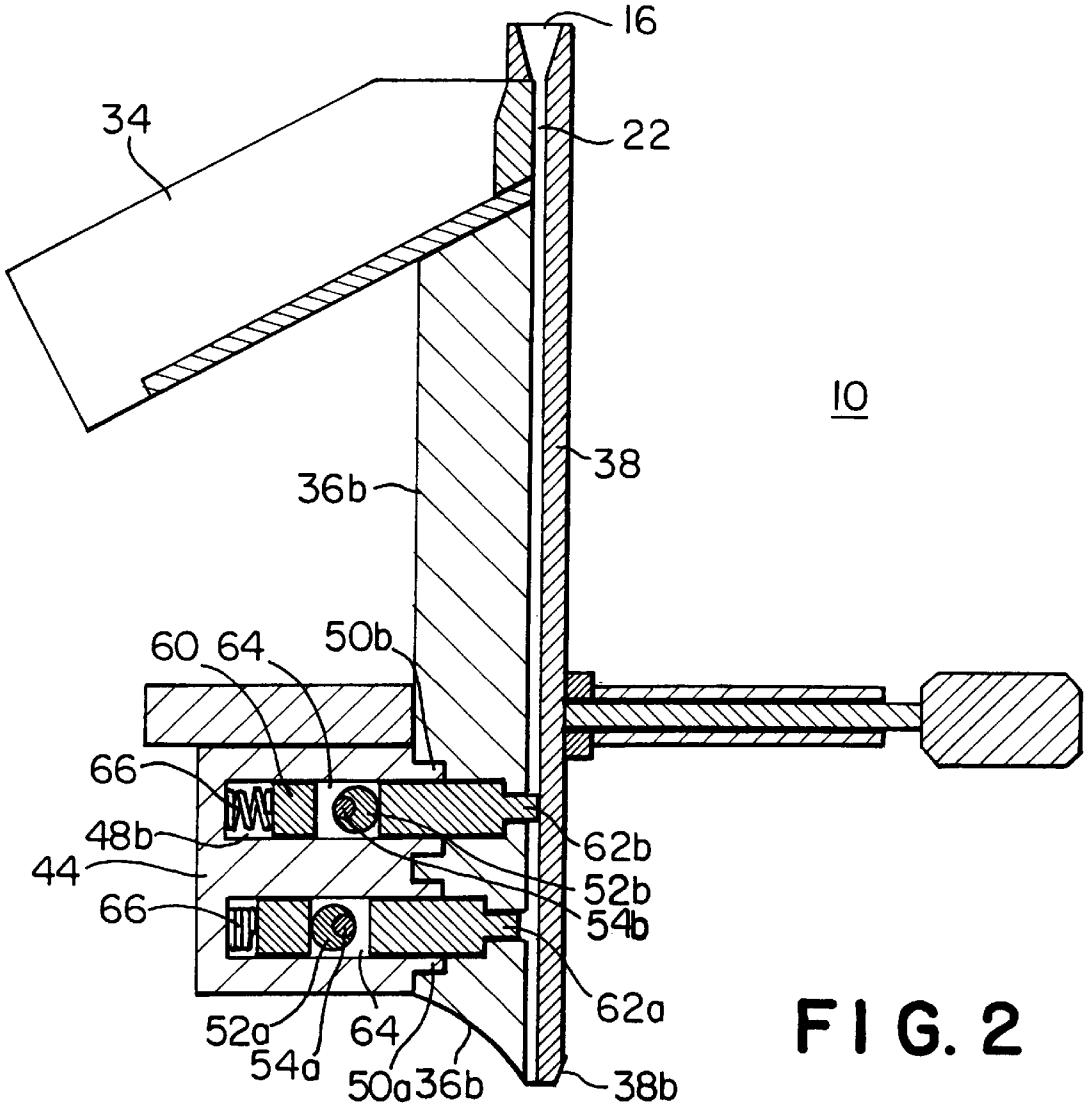
FIG. 2 is a cross-sectional view of a coin feed device in accordance with an embodiment of the present invention.

The coin feed 10 is shown in greater detail in FIG. 2 attached to the coin chute 22 of the coin elongation machine 12. The coin chute 22 is formed by two overlapping plates 36, 38. The first plate 36 has a generally elongate, rectangular shape having a slight curvature at the bottom portion 36*b*. The first plate has a slide 34 which carries a predetermined monetary unit, such as a quarter, to a collection box (not shown). The predetermined monetary unit is the fee inserted by the customer/tourist to receive the souvenir embossed coin. The coin or metal blank, which is also inserted by the customer/tourist, by-passes the slide 34 and enters the coin chute 22.

Figure 5:
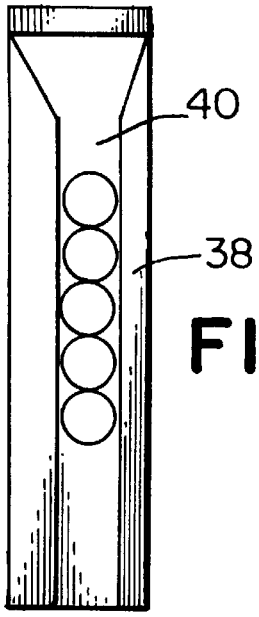
FIG. 5 is a back elevational view of the second chute plate shown in FIG. 3 including coins stacked therein.

The second plate or cover 38 also has a generally elongate, rectangular shape with a bottom curvature 38*b*. Referring to FIG. 5, the second plate 38 has a shallow groove 40 formed therein along the entire length of the cover 38. In a preferred embodiment, a penny is selected as the coin to be elongated and embossed. Therefore, the shallow groove preferably has a width slightly larger than the width of a penny and a depth slightly greater than the thickness of a penny. The upper end of the groove tapers outwardly, thereby forming a funnel section for directing pennies into the chute 22. The coin chute 22 is formed when the first and second plates are fastened together by a clamp mechanism 42 in the abutting arrangement shown in FIG. 2.

Figure 6:
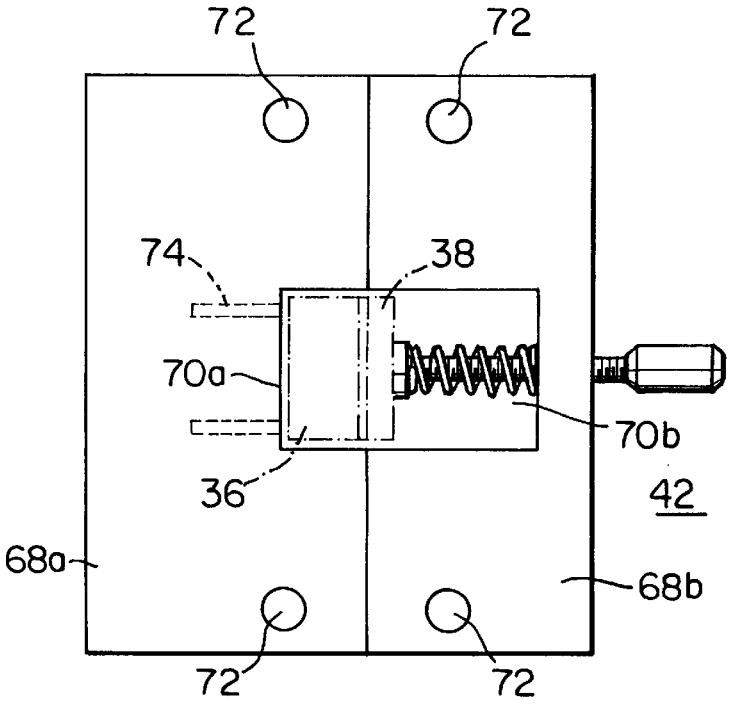
FIG. 6 is a top plan view of clamp mechanism shown in FIG. 2.
Figures 7A, 7B, 7C, 7D:
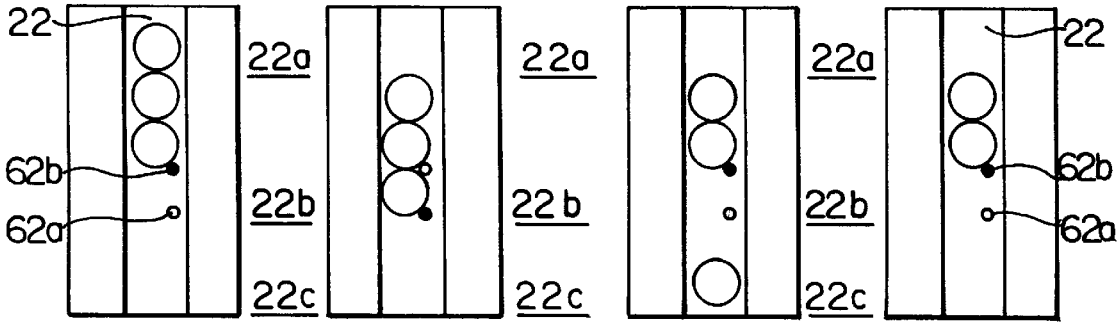
FIGS. 7(*a*)–(*d*) are schematic illustrations of the advancement of a coin to embossing rolls in accordance with an embodiment of the invention.

Referring to FIG. 6, the first and second chute plates 36, 38 are shown in a phantom and are held in abutting engagement by the clamp mechanism 42. The clamp mechanism 42 comprises two rectangular, metallic plates 68*a*, 68*b*. Each plate has a rectangular notch 70*a*, 70*b* in one side of the plate. The notches 70*a*, 70*b* are dimensioned to accept the first and second chute plates 36, 38 in the cofiguration shown in FIG. 6. Both plates are fastened to the frame of the coin elongation machine with removable fasteners inserted through opposed apertures 72. The first plate 72*a* is fastened to the coin chute 22 by machine screws inserted through the first chute plate 36 and into elongate, threaded bores 74 in the first clamp plate 68*a*.

The second clamp plate includes a thumb screw 76 having a knurled, tightening end 76*a* and a flanged, clamping end 76*b*. An anti-vibration compression spring 78 is located over the shank of the screw inbetween the flanged end 76*b* and the inner surface of the notch 70*b*.

Figure 3:
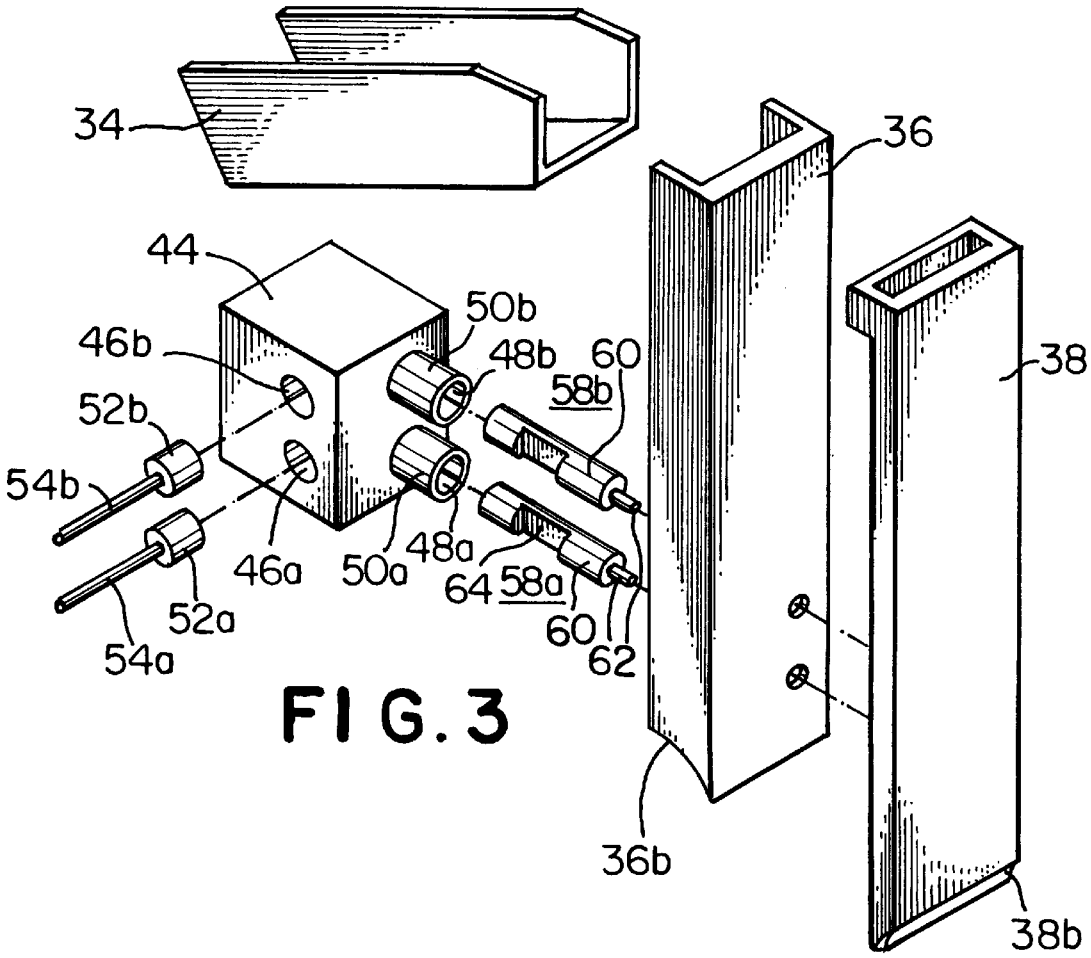
FIG. 3 is a simplified, exploded perspective of a coin feed device in accordance with an embodiment of the present invention.
Figure 4:
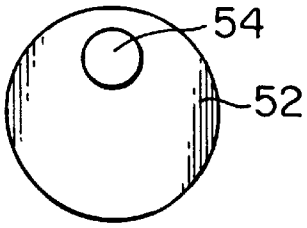
FIG. 4 is a side elevational view of a cam shown in FIG. 3.

Referring to FIGS. 2 and 3, the coin feed 10 has a cube-shaped housing. The housing 44 has two pair of cylindrical bores extending into the housing. The first pair of bores 46*a*, 46*b* and the second pair of bores 48*a*, 48*b* intersect at right angles inside the housing 44. To ensure proper alignment and affixation of the housing to the first plate 36, the housing has a pair of protruding bore extensions or tabs 50*a*, 50*b* as best seen in FIG. 3. The extensions 50*a*, 50*b* are inserted into a pair of bores in the back face 36*b* of the first plate 36 as best seen in FIG. 2.

Referring to FIG. 3, the coin feed 10 has two eccentric cams 52*a*, 52*b*, each of which is fixed to the end of a cam shaft 54*a*, 54*b*, respectively. The cam shafts 54*a*, 54*b* extend outwardly beyond the outer surface of the housing 44 so that the coin feed gears 32*a*, 32*b*, respectively, can be mounted thereon. The coin feed gears 32*a*, 32*b* are affixed to the outer end of the cam shafts 54*a*, 54*b* by drive pins 56 which extend through the hub of the gears 32*a*, 32*b* and through the end of the cam shafts 54*a*, 54*b*.

The cams 52*a*, 52*b* cooperate with a pair pin actuator mechanisms 58*a*, 58*b* which slide linerally within the elongate bores 48*a*, 48*b*. The pin actuator mechanisms 58*a*, 58*b* comprise an elongate, cylindrical slide portion 60 and an elongate cylindrical pin portion 62 fixed to and extending from one end of the slide 60. The slide 60 has a cam notch 64 cut out of the outer cylindrical surface of the slide intermediate the length of the slide 60. As best seen FIG. 2, the cam 52 is dimensioned to fit into the cam notch 64. As the cams 52 rotate, the cams alternatively contact the front and back of the notch, thereby pushing the slide forward or backward within the cam bores 46*a*, 46*b*. In a preferred embodiment, each pin actuator mechanisms is biased toward the coin chute by a compression spring 66 seated in each of the elongate bores 48*a*, 48*b* as best seen in FIG. 2.

The eccentric construction of the cams causes the pin actuator mechanisms 58 to oscillate in a defined sequence between an open limit position and a closed limit position. Referring to FIG. 2, in the closed limit position, the pin 62*b* of the pin actuator mechanism 58*b* extends into and across the chute, thereby preventing coins from advancing past the pin 62. In the open limit position, the pin 62*a* is retracted out of the coin chute 22, thereby allowing coins to advance past the pin 62*a*. The pins oscillate in the cam bores 46 in opposite directions beween the open and closed limit positions. Thus, when the first pin 62*a* is in the open limit position, the second pin 62*b* is in the closed position, and vice versa. This cycle advances a single coin/blank to the embossing rolls in the manner illustrated in FIGS. 7*a*–7*d*.

The pins 62 divide the coin chute 22 into a storage region 22*a* intermediate the coin slot 16 and the upper pin 62*b;* a unit region 22*b* intermediate the upper pin 62*b* and the lower pin 62*a;* and a supply region 22*c* intermediate the lower pin 62*a* and the embossing rolls 18.

Referring to FIG. 7(*a*), one or more coins are initially inserted into the coin chute by the customer/tourist and become stacked in the storage region above the upper pin 62*b* which is in a closed position. Referring to FIG. 7(*b*), the upper pin 62*b* then moves to an open position allowing the lead (lowest in the stack) coin to advance downwardly into the unit region and contact the lower pin 62*a* which simultaneously moved to a closed position. Referring to FIG. 7(*c*), the upper pin 62*b* moves back to a closed position to prevent additional coins from entering the unit region. Simultaneously, the lower pin 62*a* moves to an open position to allow the single coin in the unit region to advance through the chute to the embossing rolls. Referring to FIG. 7(*d*), the feed device 10 is then loaded in the same configuration as FIG. 7(*a*) and set to repeat the cycle.

The cycle of the pin actuator mechanisms is synchronized by the gear train so that a coin/blank is dropped into the embossing rolls at the precise radial location, i.e., when an embossing plate 20 is immediately proximate the contact point P between the two embossing rolls 18. The gear ratio of the gear train is dependent on the number of embossing plates 20 located around the embossing roll. The size of the gears 24, 26, 28, 30 is selected so that the coin feed advances a single coin to the embossing plates 20 every time an embossing plate is radially located immediately proximate the contact point P. In other words, the coind feed advances a single coin to the embossing plates every 1/N revolutions of the embossing plates.

In a preferred embodiment, the embossing roll will have multiple embossing plates having different designs. In the embodiment illustrated in FIG. 2, for example, each embossing plates may create the image of a different past president such as George Washington and Abraham Lincoln.

To operate the coin elongation machine, the customer is instructed to initially select the desired design by rotate an outside crank until the desired design aligns with an indicator. The indicator corresponds in location to the embossing plates on the embossing rolls. The customer is then instructed to insert the fee (for example, one quarter) as well as a penny/blank. Finally, the customer is instructed to rotate the crank a predetermined number of times or until the souvenir discharges from the machine.

The coin elongation machine of the present invention safeguards against two common customer errors or defections from the aforementioned instructions. First, if the customer does not properly initially configure the machine by aligning the desired design with the indicator, a correct and properly rolled souvenir will still be produced so long as the misalignment is within the built in margin of alignment error. In the present invention, the margin of alignment error is plus or minus ½N revolutions. In prior art machines, a defective souvenir is produced if the coin elongation machine is not precisely configured initially.

Second, if the customer inserts the penny/blank before initially configuring the machine, a properly rolled souvenir will still be produced, although the design may not be the design desired by the customer. In prior art machines, a defective souvenir is produced if the penny/blank is inserted into the coin elongation machine before initially configuring the machine.

I claim:

1. A souvenir coin elongation machine comprising:

a housing;

a coin slot formed in the top of said housing, said coin slot having a width slightly larger than the diameter of the coin and a depth slightly larger than the thickness of the coin;

a pair of embossing rolls having a predetermined number (N) of embossing plates spaced equally around the outer circumferential surface of at least one of said embossing rolls, said embossing rolls constructed and arranged to permanently deform the coin and emboss a souvenir logo therein;

manual crank means extending to the outside of said housing for rotating said embossing rolls;

a gravity fed coin chute connecting said coin slot to said embossing rolls, said coin chute having a width slightly larger than the diameter a penny and a depth slightly larger than the thickness of a penny;

a mechanical coin feed located intermediate said coin chute, said coin feed mechanically linked to said rolls by a gear train and synchronized with said rolls to advance only one coin at a time to said embossing rolls for every 1/N revolutions of said embossing rolls; and, said embossing plates contacting the other embossing roll at a contact point P every 1/N revolutions of said embossing rolls, said coin feed only admitting a coin to said embossing rolls immediately before the embossing rolls are rotated to each contact point P, wherein said machine is constructed and arranged to produce a souvenir coin by inserting a penny into said coin chute and manually rotating said crank means.

2. The coin elongation machine recited in claim 1, said embossing plates contacting the other embossing roll at a contact point P every 1/N revolutions of said embossing rolls, said coin feed only admitting a coin to said embossing rolls immediately before the embossing rolls are rotated to each contact point P.

3. The coin elongation machine recited in claim 1, said coin feed being mechanically linked to said embossing rolls by a gear train.

4. The coin elongation machine recited in claim 3, said coin feed including a pair of stops, each stop being movable between a closed position preventing a coin from advancing past said stop in said chute, and an open position allowing a coin to advance past said stop in said chute.

5. The coin elongation machine recited in claim 4, said stops retracting out of said chute in an open position and traversing the chute in a closed position.

6. The coin elongation machine recited in claim 5, said stops comprising pin actuator mechanisms having an elongate, cylindrical slide portion and an elongate, cylindrical pin portion.

7. The coin elongation machine recited in claim 6, including a cam mechanically linked to said gear train and each of said pin actuator mechanisms, said cams and gear train constructed and arranged so that said stops open and close in a defined cycle wherein said first stop is open when said second stop is closed and vice versa.

8. The coin elongation machine recited in claim 7, said slide portion having a cam notch formed in the outer cylindrical surface intermediate the ends of said slide portion, said cam rotating within said cam notch to move said slide back and forth.

9. The coin elongation machine recited in claim 8, including a compression spring biasing said pin actuator mechanism toward a closed position.

10. The coin elongation machine recited in claim 4, said stops dividing said coin chute into a storage region intermediate said slot and said first stop, a unit region intermediate said first and second stops, and a supply region intermediate said second stop and said embossing rolls.

11. The coin elongation machine recited in claim 10, said storage region being large enough to contain multiple coins.

12. The coin elongation machine recited in claim 10, said unit region being large enough to contain only one full coin.

13. The coin press recited in claim 3, said stops being offset from the widthwise center of said chute.

14. A method of making a souvenir coin comprising the steps of:

a) providing a souvenir coin elongation machine having:
   i) a housing;
   ii) a coin slot formed in the top of said housing, said coin slot having a width slightly larger than the diameter of a coin and a depth slightly larger than the thickness of a coin;
   iii) a pair of embossing rolls constructed and arranged to permanently deform the coin and emboss a souvenir logo therein, at least one of said rolls having a predetermined number (N) of embossing plates on the outer circumferential surface of said roll, said embossing plates contacting the other embossing roll at a contact point P every 1/N revolutions of said embossing rolls;
   iv) manual crank means connected to said embossing rolls and extending to the outside of said housing for rotating said embossing rolls;
   v) a gravity fed coin chute connecting said coin slot to said embossing rolls;

b) storing multiple coins in said coin chute;

c) mechanically advancing only one coin to said embossing rolls for every 1/N revolutions of said embossing rolls only immediately before the embossing rolls are rotated to each contact point P;

d) permanently deforming and embossing the coin with said rolls to create a souvenir coin.

15. The method recited in claim 14, including the step of only advancing a coin to said embossing rolls immediately before an embossing plate contacts the other embossing roll at each contact point P.

16. A coin feed for a souvenir coin elongation machine having a housing, a coin slot formed in the top of the housing, said coin slot having a width slightly larger than the diameter of a coin and a depth slightly larger than the thickness of a coin, a pair of embossing rolls having a predetermined number (N) of embossing plates spaced equally around the outer circumferential surface of at least one embossing roll, manual crank means connected to said embossing rolls and extending to the outside of said housing for rotating said embossing rolls, and a gravity fed coin chute connecting the coin slot to the embossing rolls, said coin chute having a width slightly larger than the diameter of a penny and a depth slightly larger than the thickness of a penny, said coin feed comprising;

(a) a coin feed housing:

(b) a pair of stops, each stop being movable between a closed position traversing the coin chute and an open position retracted out of said coin chute, each stop being mechanically linked to said embossing rolls;

said mechanical coin feed located intermediate said chute and constructed and arranged to selectively advance only one coin at a time to said embossing rolls each time said embossing rolls are rotated 1/N revolutions only immediately before the embossing rolls are rotated to each contact point P.

17. The coin feed recited in claim 16, said embossing plates contacting the other embossing roll at a contact point P every 1/N revolutions of said embossing rolls, said coin feed only admitting a coin to said embossing rolls immediately before the embossing rolls are rotated to each contact point P.

18. A souvenir coin elongation machine comprising:

a housing;

a coin slot formed in the top of said housing, said coin slot having a width slightly larger than the diameter of the coin and a depth slightly larger than the thickness of the coin;

a pair of embossing rolls having a predetermined number (N) of embossing plates spaced equally around the outer circumferential surface of at least one of said embossing rolls, said embossing rolls constructed and arranged to permanently deform the coin and emboss a souvenir logo therein;

manual crank means fixed to said embossing rolls and extending to the outside of said housing for rotating said embossing rolls;

a gravity fed coin chute connecting said coin slot to said embossing rolls, said coin chute having a width slightly larger than the diameter of a penny and a depth slightly larger than the thickness of a penny;

a mechanical coin feed located intermediate said coin chute, said coin feed mechanically linked to said rolls by a gear train and synchronized with said rolls to advance only one coin at a time to said embossing rolls for every 1/N revolutions of said embossing rolls;

said embossing plates contacting the other embossing roll at a contact point P every 1/N revolutions of said embossing rolls, said coin feed only admitting a coin to said embossing rolls immediately before the embossing rolls are rotated to each contact point P;

wherein said machine is constructed and arranged to produce a souvenir coin by inserting a penny into said coin chute and manually rotating said crank means;

said coin feed including a pair of stops, each stop being movable between a closed position preventing a coin from advancing past said stop in said chute, and an open position allowing a coin to advance past said stop in said chute;

said stops retracting out of said chute in an open position and traversing the chute in a closed position;

said stops comprising pin actuator mechanisms having an elongate, cylindrical slide portion and an elongate, cylindrical pin portion;

said stops dividing said coin chute into a storage region intermediate said slot and said first stop, a unit region intermediate said first and second stops, and a supply region intermediate said second stop and said embossing rolls;

said storage region being large enough to contain multiple coins;

said unit region being large enough to contain only one full coin;

including a cam mechanically linked to said gear train and each of said pin actuator mechanisms, said cams and gear train constructed and arranged so that said stops open and close in a defined cycle wherein said first stop is open when said second stop is closed and vice versa, said slide portion having a cam notch formed in the outer cylindrical surface intermediate the ends of said slide portion, said cam rotating within said cam notch to move said slide back and forth;

including a compression spring biasing said pin actuator mechanism toward a closed position;

said stops being offset from the widthwise center of said chute.

* * * * *